United States Patent [19]

Kees

[11] Patent Number: 4,593,673

[45] Date of Patent: Jun. 10, 1986

[54] SLING SHOT GUN STRUCTURE

[76] Inventor: Galen D. Kees, Rte. 2, Box 17B, Durand, Wis. 54736

[21] Appl. No.: 727,512

[22] Filed: Apr. 26, 1985

[51] Int. Cl.[4] ..... F41B 3/00

[52] U.S. Cl. ..... 124/20 B; 124/22; 124/35 R; 124/41 R; 124/41 A

[58] Field of Search ..... 124/20, 17, 22, 35 R, 124/41 A, 41 R, 24 R, 25

[56] References Cited

U.S. PATENT DOCUMENTS

| | | | |
|---|---|---|---|
| 440,538 | 11/1890 | Bruton | 124/35 R X |
| 1,581,626 | 4/1926 | Barth | 124/22 X |
| 1,832,340 | 11/1931 | Williams | 124/35 R X |
| 2,501,568 | 3/1950 | Jarnagin | 124/20 R |
| 2,613,659 | 10/1952 | Hutson | 124/20 B |
| 2,638,885 | 5/1953 | Keadle | 124/20 |
| 2,645,217 | 7/1953 | Fisher | 124/20 B |
| 2,708,924 | 5/1955 | Hurlburt | 124/17 |
| 2,896,604 | 7/1959 | Rebikoff | 124/22 |
| 3,857,379 | 12/1974 | Burghardt | 124/20 B X |
| 4,278,065 | 7/1981 | Wales | 124/20 R |
| 4,318,389 | 3/1982 | Kiss, Jr. | 124/22 |
| 4,372,282 | 2/1983 | Sanders | 124/24 R |

FOREIGN PATENT DOCUMENTS

| | | | |
|---|---|---|---|
| 620284 | 10/1935 | Fed. Rep. of Germany | 124/20 R |
| 1240973 | 8/1960 | France | 124/22 |
| 1556026 | 12/1968 | France | 124/20 B |

*Primary Examiner*—Paul E. Shapiro

*Attorney, Agent, or Firm*—Leo Gregory

[57] ABSTRACT

A sling shot device consisting of a gun stock having an extensible rod like barrel, an elastic band carried by the barrel, a member holding the band under tension while loaded with a missile, the barrel and stock having sights and a band releasing member. The sling shot structure is adaptable to use a conventional arrow as a missile.

13 Claims, 10 Drawing Figures

SLING SHOT GUN STRUCTURE

BACKGROUND OF THE INVENTION

1. Field of Invention.

This invention relates to a hand held and hand operated catapult or sling shot type of a gun structure.

2. Description of the prior art.

There is a long history of the use of sling shot or catapult types of weapons, ranging from home made sling shots to more sophisticated types embodying metal fork frames and barrel and stock structures simulating both pistol and rifle types of gun structures.

The more sophisticated types of structures permit cocking a missile loaded band for later release in which the bands as known are held under tension mechanically with a trigger type of member to release the band.

SUMMARY OF THE INVENTION

The device herein comprises a sling shot or catapult type structure which simulates a rifle structure and provides for the use either of a steel ball or pellet type missile or for the use of a conventional arrow.

It is an object of the device herein to provide such an arrangement that the catapult band is not directly placed under tension by hand.

It is a further object herein to provide a device having an extensible barrel and a member to hold the catapult band in operating position loaded with a missile while the barrel is locked into an extended position to place the band under tension.

More specifically, it is an object of this invention to provide a rifle simulating sling shot type of device having an extensible barrel with a releasable locking lever, means holding the catapult band under tension while loaded with a missile, said means being particularly adapted to release the catapult uniformily and sights for accurate flight of the missile.

It is a further object to have the device herein adaptable to be loaded with a conventional arrow for a missile.

These and other objects and advantages of the invention will be set forth in the following description made in connection with the accompanying drawings in which like reference characters refer to similar parts throughout the several views.

DESCRIPTION OF A PREFERRED EMBODIMENT

Figures 1, 2, 3:
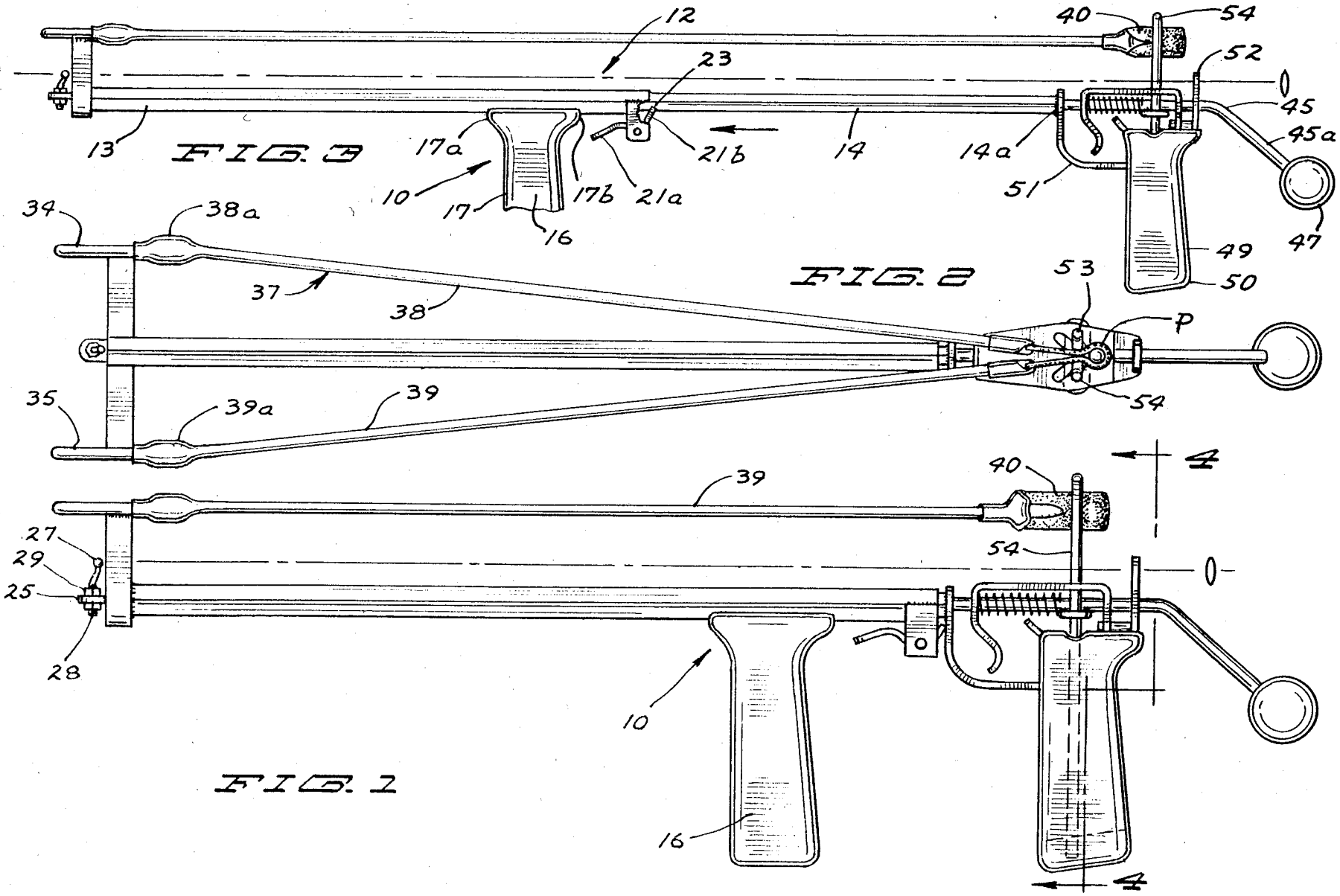
FIG. 1 is a side elevational view of the sling shot structure herein.
FIG. 2 is a top plan view of the structure of FIG. 1.
FIG. 3 is a view similar to that of FIG. 1 showing the structure in extended form.
Figure 6:
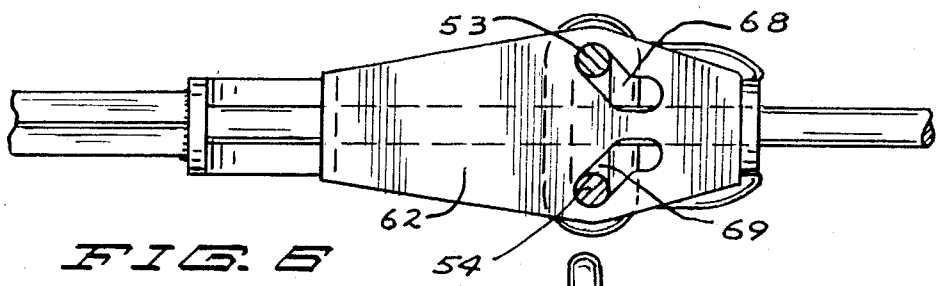
FIG. 6 is a broken view in top plan taken on line 6—6 of FIG. 5 as indicated.
Figure 5:
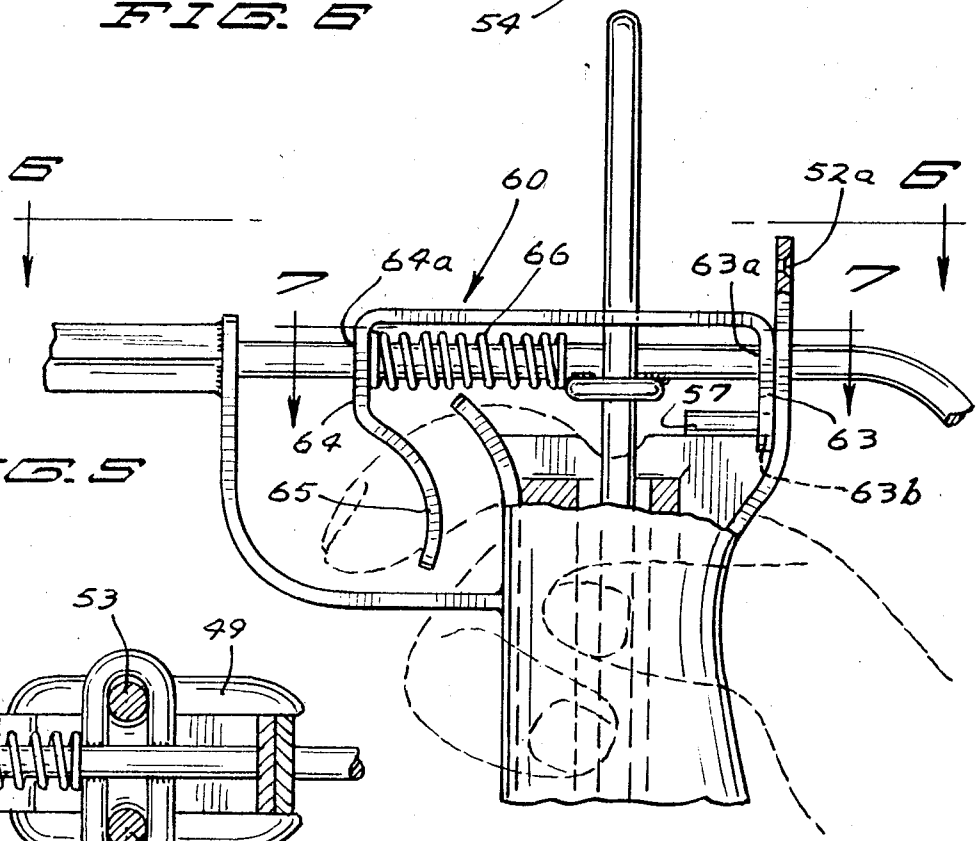
FIG. 5 is an enlarged side elevational view of a detail of the trigger structure on an enlarged scale.
Figure 7:
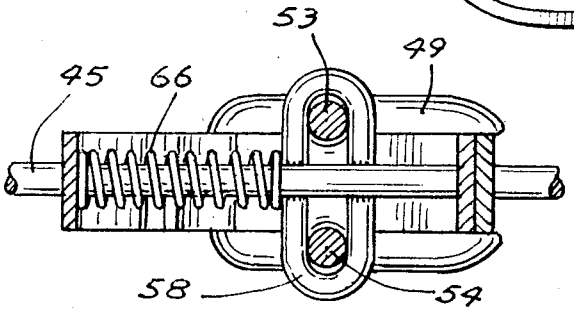
FIG. 7 is a detail of structure in horizontal section taken on line 7—7 of FIG. 5 as indicated.

Referring to the drawings, a preferred embodiment of a sling shot or catapult device or structure 10 is shown.

Comprising said device is a barrel 12 consisting of telescopic or extensible portions 13 and 14. Said barrel is conveniently formed of standard stock square tubing with the portion 14 having such a dimension as to have an interfitting sliding telescopic engagement with the portion 13.

Depending from adjacent the inner end of the barrel portion 13 is handle 16 shown here enclosed within a metal band 17 having its upper end portions **17*a* and 17*b*** welded or soldered to said barrel portion as shown.

Depending from the inner end portion **13*a* of the barrel portion 13 is a U-shaped bracket 19 having a transverse pin 20 therethrough to which is secured for pivotal movement therewith a lever 21 and having a finger engaging portion 21*a* extend towards the handle 16 and having an oppositely upwardly extending tongue portion 21*b* which, when the barrel portions 13 and 14 are extended, engages the notch 23 at the adjacent bottom of the barrel portion 14, said engagement holds the barrel portions 13 and 14 in extended position against the tension of an elastic band member as will be described. There may be one or more other notches in the barrel portion 14 for less than full extensions of said barrels 13 and 14**.

Projecting from the forward end **13*a* of said barrel portion 13 is a stub plate member 25 secured by welding or soldering. Upstanding from said plate is an archery type sight pin 27 as shown mounted upon a bolt 28 which extends vertically through said plate member 25 have locknuts 29** above and below said plate for vertical adjustment of said sight pin. Said pin is vertically off-center for horizontal adjustment as is conventional with such a sight.

Secured to the forward end of the barrel portion 13 as by soldering is a fork member 30 consisting of two diverging arms 31 and 32 here diverging at an angle of approximately 45° . Secured at the upper end of said arms are short rods 34 and 35, the same extending forwardly and rearwardly of said arms.

A suitable elastic band member 37 is secured at one end thereof to said rods. Said band member which is the catapulting agent may be variously formed but in the present embodiment it is shown and described as comprising a pair of elastic tubes 38 and 39, each secured at the outer ends **38*a* and 39*a* thereof onto the adjacent ends of said rods 34 and 35 as by being pulled onto enlarged end portions of said rods as shown and at their other or inner ends they are connected by a suitably flexible strap like pellet pouch 40**.

The adjacent ends of said barrel portions 13 and 14 interengage within the barrel portion 13 in a conventional manner to prevent disengagement and such structure is known in the art and is not here shown.

The barrel portion 14 has a round rod 45 extending outwardly of the free end **14*a* thereof and the same is secured as by soldering. Said rod extends outwardly and is angled downwardly at 45*a* having what is shown as a ball 47 secured at its free end. Said ball 47** forms a cheek rest.

Depending from said rod is a handle or better termed a pistol grip 49 encircled by a metal band 50.

Said band 50 has a forwardly upwardly angled portion 51 which is apertured to have said rod 45 extend therethrough at the end of said barrel portion 14 and said rod is also soldered to the adjacent end of said barrel portion 14. Said band 50 at the rear side of said grip has an upwardly extending portion 52 which is apertured to have said rod pass therethrough and which is also secured to said rod as by soldering.

Figure 4:
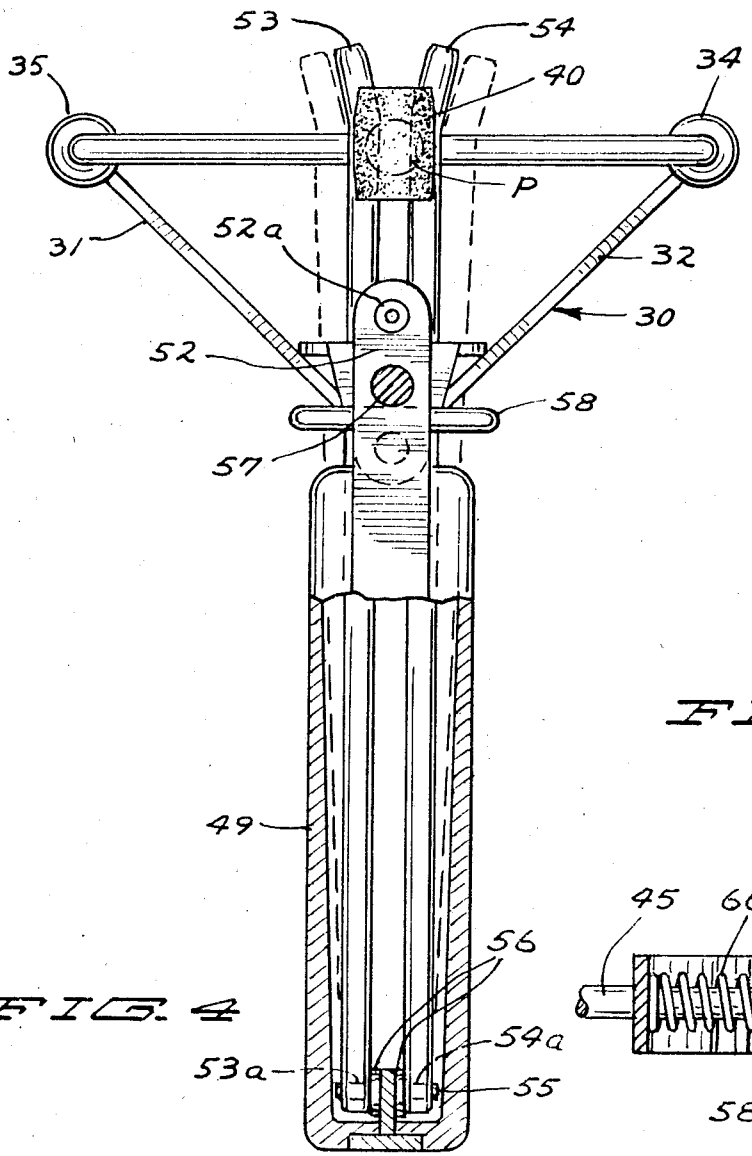
FIG. 4 is an enlarged view in vertical section taken on line 4—4 of FIG. 1 as indicated.
Figure 8:
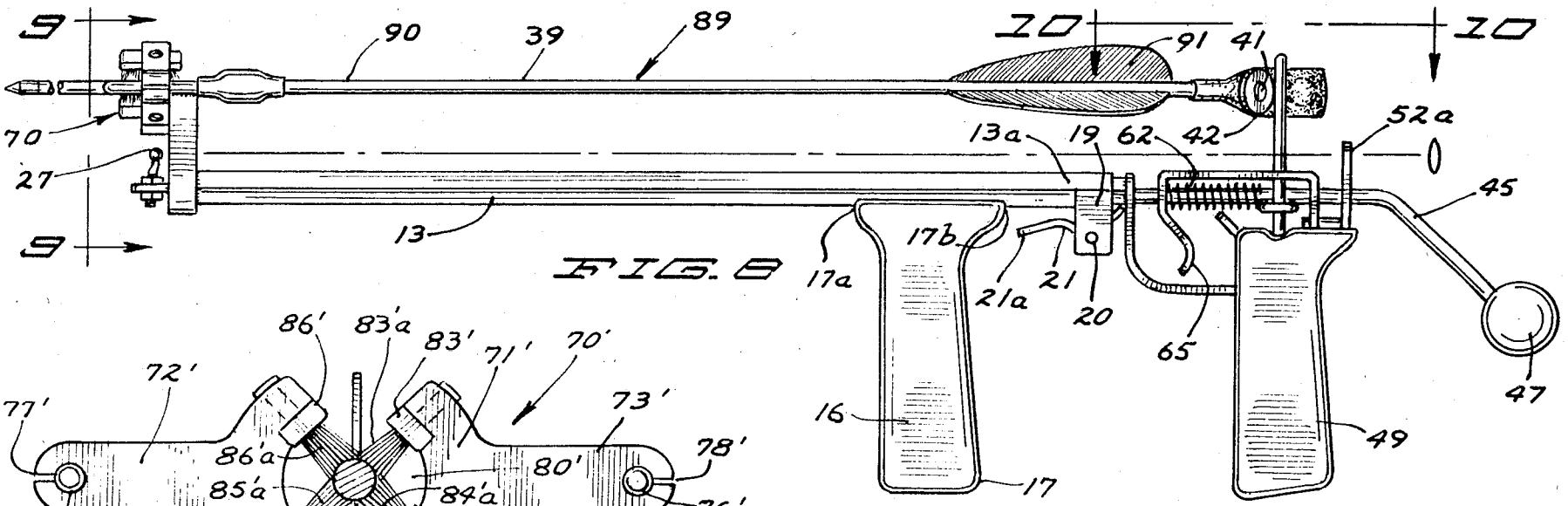
FIG. 8 shows a modification of the structure herein in side elevation.

Extending upwardly from within said grip 49 are a pair of transversely spaced pouch pins 53 and 54 which are secured within said grip (FIG. 4) by having their lower ends apertured as at 53*a* and 54*a* and having a transverse pin 55 disposed therethrough, said pouch pins being positioned on said transverse pin by spacer sleeves 56. Said pins extend upwardly at each side of said rod 45. Encircling said pins under said rod is an elongated ring 58 rigidly connected to said rod 45. Said ring guides the transverse movement of said pouch pins.

A triggering mechanism 60 is mounted upon said rod 45 to spread said pouch pins and release a missile.

Said triggering mechanism comprises a flat top plate member 62 having a downwardly angled rear portion 63 apertured at 63*a* to accommodate said rod 45 and a downwardly angled forward end portion 64 apertured at 64*a* to accommodate said rod 45, said forward end portion being curved downwardly to form a trigger as indicated at 65. Said member 60 is thus slidingly positioned on said rod.

Cut into said flat top 62 are a pair of transversely spaced forwardly diverging arcuate slots 68 and 69 having said pouch pins 53 and 54 extending upwardly therethrough.

Disposed onto said rod 45 between said downwardly angled forward portion 64 and said ring 58 and bearing thereagainst is a compression coil spring 66.

The upwardly extending portion 52 of the band 50 has at its lower portion under said rod 45 a forwardly extending pin 57. Said depending rear end portion 63 of said plate member 62 has at its lower rear end portion an aperture 63*b* which has said pin 57 extending thereinto. Thus said pin is a guide for the triggered movement of said plate member 62, said coil spring 66 normally urges said plate member 62 to its forward position.

Referring again to said upwardly extending portion 52, the same has a small aperture 52*a* through its upper portion forming a sight to be used in conjunction with the sight pin 27.

OPERATION

The structure described herein has proved to be a very accurate and effective weapon.

For the most part a steel ball or pellet P will be used for a missile. The pellet will be loaded into the pouch 40. The pouch will be grasped by the fingers of the operator just in front of the missile and pulled rearwardly against the tension of the band member 37. The barrel 12 at this point is not extended. The bulge in the pouch formed by the missile will be sufficient for retention behind the pouch pins 53 and 54. It is noted that the ring 58 prevents any forward movement of said pouch pins.

With the band member 37 positioned as described, the handles 16 and 49 are grasped. The handle 16 is moved forwardly to the full extension permitted and at that point the lever 21 engages the notch 23 and holds the barrel portions 13 and 14 in extended position.

The sling shot is then held in the manner of a rifle but the ball 47 utilized as a cheek rest. The sling shot is then sighted on the order of a rifle and the trigger 65 is pulled causing the arcuate slots to uniformly spread the pouch pins 53 and 54 to release the pouch 40 and the missile therein.

The uniform spreading of the pouch pins is very significant in determining that the flight of the missile will be true to the sighting of the operator.

It will be appreciated that a lesser than full tension upon the band member 37 may be accomplished by presence of one or more additional notches intermediate said barrel portion 14.

MODIFICATION

The structure above described is adaptable for use of a conventional arrow as a missile.

The structure hereinabove described will be indicated by the same reference numerals. The part comprising the modification will be indicated by a prime being added to the reference numeral.

Adapted to be mounted onto the forward portions of the rods 34 and 35 is an arrow rest or guide member 70'. Said arrow rest as shown in its present embodiment comprises a substantially C-hub portion 71' having a pair of horizontally oppositely extending arms 72' and 76', said apertures having radial slits 77' and 78' to provide some expansion for a tight fit of said apertures upon said rods 34 and 35.

Figure 10:
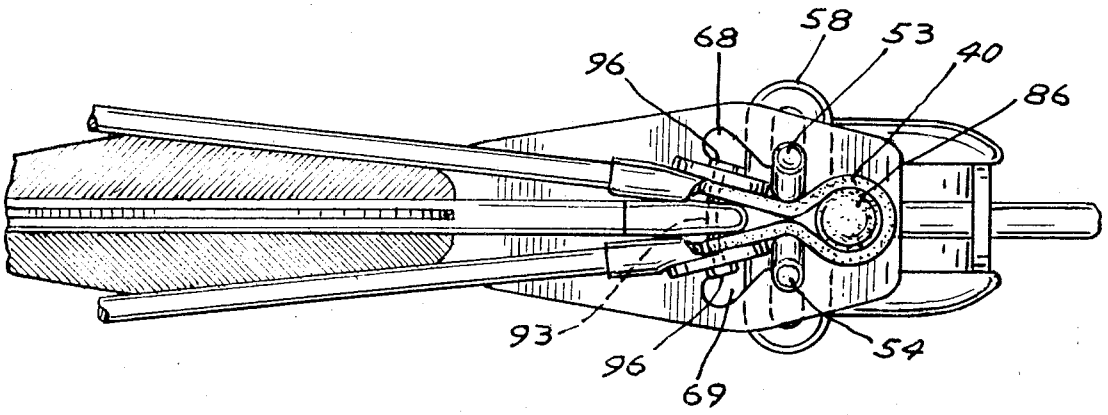
FIG. 10 is a broken view in top plan taken on line 10—10 of FIG. 8 as indicated.
Figure 9:
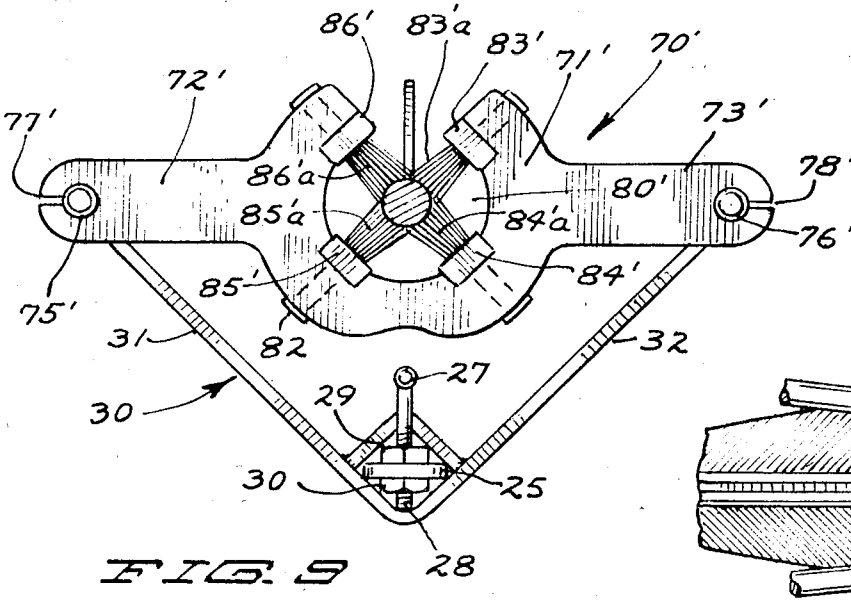
FIG. 9 is a view in end elevation taken on line 9—9 of FIG. 8.

Said hub portion 71' defines a circular chamber 80' therein. Equally spaced about said chamber and suitably secured to said hub as by rivets 82 are the arrow shaft support members 83'–86'. As here shown these support members are in the form of small brushes of which the bristles 83'*a* –86'*a* support the shaft 90 of an arrow 89 and permit the fletched portion 91 of the arrow to slide through without any appreciable resistance or deflection of its aim. In FIG. 10, a member 87 is shown in the pouch to extend or fill the pouch to enable the same to be retained by the pouch pins 53 and 54 to cock the arrow until its release.

Said arrow 89 is a conventional arrow. In the use of an arrow, a nocking cord 93 is extended transversely through the pouch 40 as shown in FIG. 10, being removably received by the buttons 96 at the outer sides of said pouch. Said pouch is slitted, not here shown, to permit the passage of the buttons.

In operation, the sling shot is cocked as above described, being loaded with a missile to hold the band member 37 in an extended cocked position. The arrow is then positioned extending the shaft through the rest or guide member 70' and the nock thereof, not shown but as indicated in FIG. 10, is engaged with the cord 93. The arrow is thus positioned with respect to the band member 37 under tension and is held at ready to be released for flight by release of said band member.

Thus there has been provided a dual purpose sling shot structure which, with the addition of one element, may be readily converted from the use of a pellet missile to an arrow missile in a very simple and efficient operation.

It will of course be understood that various changes may be made in form, details, arrangement and proportions of the parts without departing from the scope of applicant's invention herein which, generally stated, consists in an apparatus capable of carrying out the objects above set forth, in the parts and combinations of parts disclosed and defined in the appended claims.

What is claimed is:

1. A sling shot device, having in combination an extensible barrel, means holding said barrel in extended position, a forward and rearward handle carried by said barrel,
a pair of pins upstanding from said rearward handle transversely of said barrel,
a plate member,
a depending portion of said plate member forming a trigger,
a pair of arcuate forwardly diverging slots in said plate member having said upstanding pin extending therethrough,
an elastic divided band member,
means securing said band member in transversely spaced relation to the front end position of said barrel,
a missile pouch connected to the other end of said band member,
said pouch being adapted to retain a missile therein and said pins retaining said pouch having a missile therein, and
said trigger moving said plate member to spread said pins and release said pouch and missile therein.

2. A sling shot device, having in combination
an extensible barrel,
means holding said barrel in extended position,
a forward and rearward handle carried by said barrel,
a rearward extension of said barrel carrying said rearward handle,
a pair of pins upstanding from said rearward handle at either side of said rearward extension,
a plate member overlying said extension,
a trigger depending from said plate member,
a pair of arcuate forwardly diverging slots in said plate member having said upstanding pins extending therethrough,
an elastic divided band member,
means securing said band member at one end thereof in transversely spaced relation to the front end portion of said barrel,
a missile pouch connecting the other ends of said band member,
said pouch being adapted to retain a missile therein and said pins retaining said pouch having a missile therein, and
said trigger moving said plate member to spread said pins and release said pouch loaded with a missile.

3. The structure of claim 2, wherein
said barrel comprises a forward and rearward portion having telescopic interengagement.

4. The structure of claim 2, including
a coil spring disposed onto said rearward extension underlying said plate member urging said trigger forwardly.

5. The structure of claim 2, including
an annular member underlying said rearward extension encircling said upstanding pins.

6. The structure of claim 2, wherein
said rearward handle has a pin transversely disposed therein, extending through the lower end portions of said upstanding pins providing movement of said pins toward and away from each other.

7. The structure of claim 2, wherein
said rearward handle has a metal band thereabout having upstanding forward and rearward end portions, said end portions having said rearward extension pass therethrough, and
said rearward end portion having a rear sight formed therein.

8. The structure of claim 2, wherein said plate member has a depending rear end portion,
said rearward extension passes through said depending portion,
said rearward handle has a metal band thereabout having an upwardly projecting portion having a forwardly projecting pin,
said depending rear end portion has an aperture to have said pin pass therethrough.

9. The structure of claim 2, wherein
a cheek resting member is carried by said rearward extending portion of said barrel.

10. The structure of claim 2, wherein
an upward extending portion of said rear handle has an aperture therethrough forming a rear sight, and
means at the forward end of said barrel forming a front sight.

11. The structure of claim 2, wherein
an angle bracket having upwardly diverging arms is secured to the front end portion of said barrel,
a short rod longitudinal of said barrel is carried by each of said arms, and
means secure forward ends of said band member to the adjacent end portions of said rods.

12. The structure of claim 2, including
an arrow rest member,
means securing said rest member to the outer end portion of said barrel,
an arrow nocking cord extending transversely of said pouch, and
means expanding said pouch to be retained by said upstanding pins.

13. The structure of claim 2, including
an angled bracket having upwardly diverging arms,
means securing said bracket to said barrel at the front end portion thereof,
an arrow rest member,
means mounting said rest member onto said bracket,
said rest member comprising
a hub portion having a pair of oppositely extending arms,
said hub portion comprising a circular chamber,
spaced about said chamber in facing relation are a plurality of yielding members adapted to permit an arrow shaft to pass therebetween.
said pouch being adapted to receive the nock of said arrow, and
means expanding said pouch to be retained by said upstanding pins.

* * * * *